United States Patent [19]

Furukawa et al.

[11] 4,285,741

[45] Aug. 25, 1981

[54] PROCESS FOR PRODUCING HIGH-STRENGTH, LOW YIELD RATIO AND HIGH DUCTILITY DUAL-PHASE STRUCTURE STEEL SHEETS

[75] Inventors: Takashi Furukawa, Machida; Kazuo Koyama, Kimitsu, both of Japan

[73] Assignee: Nippon Steel Corporation, Tokyo, Japan

[21] Appl. No.: 48,546

[22] Filed: Jun. 14, 1979

[30] Foreign Application Priority Data

Jun. 16, 1978 [JP] Japan ..... 53-52801

[51] Int. Cl.[3] ..... C21D 8/02; C21D 9/46

[52] U.S. Cl. ..... 148/12 D; 148/12 F; 148/12.4; 148/36

[58] Field of Search ..... 148/12 C, 12 D, 12 F, 148/12.3, 12.4, 36

[56] References Cited

U.S. PATENT DOCUMENTS

| | | | |
|---|---|---|---|
| 3,902,927 | 9/1975 | Pernstal | 148/12 F |
| 3,951,696 | 4/1976 | Gondo et al. | 148/12 C |
| 4,023,987 | 5/1977 | Nomura et al. | 148/12 F |
| 4,026,729 | 5/1977 | Nakaoka et al. | 148/12.4 |
| 4,033,789 | 7/1977 | Hamburg et al. | 148/12 F |
| 4,159,218 | 6/1979 | Chatfield et al. | 148/36 |

FOREIGN PATENT DOCUMENTS

| | | | |
|---|---|---|---|
| 2239527 | 2/1975 | France | 148/12.4 |

*Primary Examiner*—Peter K. Skiff

*Attorney, Agent, or Firm*—Cushman, Darby & Cushman

[57] ABSTRACT

Process for producing a high strength, low yield ratio and high ductility dual-phase structure steel sheet having a structure composed mainly of a ferrite phase and a rapidly cooled transformation phase and having excellent formability with a tensile strength of 40 kg/mm$^2$ or higher. The process comprises cooling the continuously annealed steel sheet under the following conditions:

(1) 1° C./second $\leqq R_1 \leqq$ 30° C./second wherein $R_1$ represents an average cooling rate from the continuous annealing temperature down to an intermediate temperature T° C. in the cooling process.

(2) 4° C./second $\leqq R_2 \leqq$ 100° C./second wherein $R_2$ represents an average cooling rate from T° C. to a temperature not higher than 200° C., (3) $R_1 < R_2$ and (4) 420° C. $\leqq$ T $\leqq$ 700° C.

8 Claims, 10 Drawing Figures

| | Yield Strength kg/mm² | Tensile Strength kg/mm² | Average Elongation % | Total Elongation % | n Value | Yield * Ratio |
|---|---|---|---|---|---|---|
| Ⓐ | 29.6 | 62.6 | 21.0 | 31.5 | .30 | .47 |
| Ⓑ | 45.5 | 60.0 | 17.5 | 25.0 | .21 | .76 |

* Yield Strength / Tensile Strength (1) Starting Temperature Range of the Primary Cooling and the Range of the Primary Cooling Rate ($R_1$) according to the Present Invention (2) Starting Temperature Range of the Secondary Cooling and the Range of the Secondary Cooling Rate ($R_2$) according to the Present Invention (3) Range According to the Japanese Laid-Open Patent Appln. Sho 52-15046

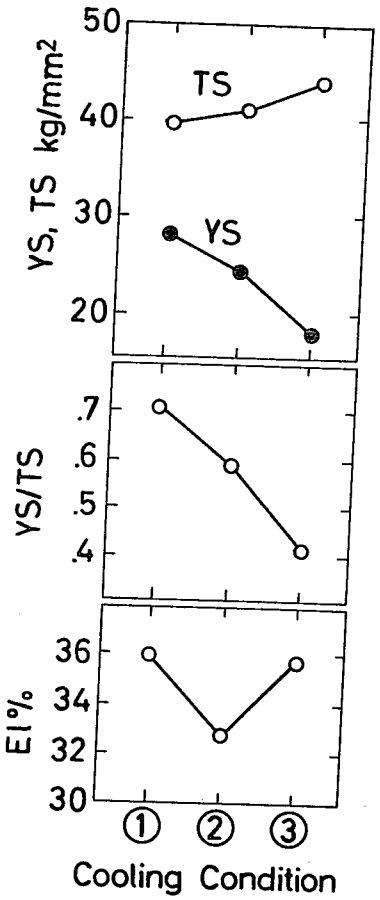
FIG.5
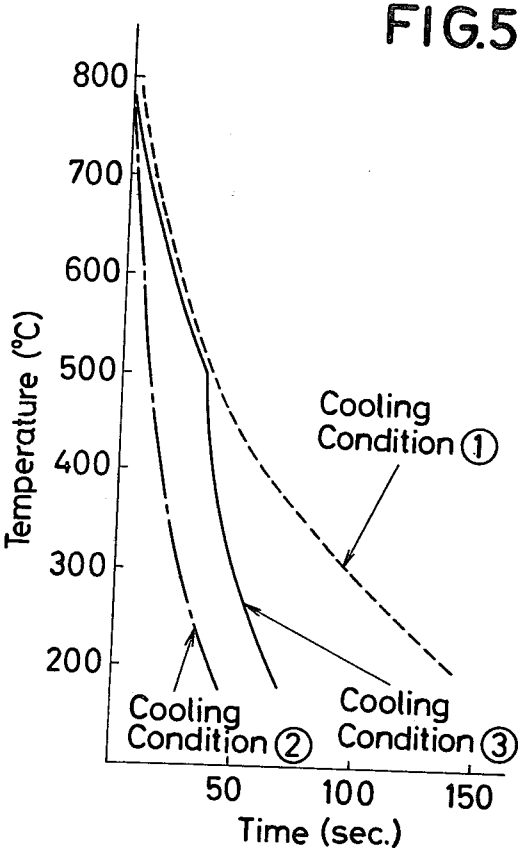

Composition
C .052%
Mn 1.48%
Cold Rolled Steel Sheet
Holding Temperature in the Continuous Annealing 800°C, 1min.
Intermediate Temperature in the Cooling Step T
T=520°C
Discrimination of the Primary Cooling Rate R1
R1=.5°C/sec.
R1=9°C/sec.
R1=15°C/sec.
R1=40°C/sec.
TS kg/mm2
60
55
50
45
40
35
30
YS/TS
.8
.7
.6
.5
.4
Low Yield Ratio Zone
El%
40
30
20
10
1
2
3
4
5
10
20
30
40
50
100
200
Secondary Cooling Rate R2 °C/sec.

Composition
C .091%
Si .44%
Mn 1.54%
Hot Rolled Steel Sheet
Holding Temperature in the Continuous Annealing 760°C, 3min.
Intermediate Temperature in the Cooling Step T
T= 530°C
Discrimination of the Primary Cooling Rate R1
R1= .5°C/sec.
R1= 3°C/sec.
R1= 5°C/sec.
R1=25°C/sec.
R1=40°C/sec.
TS kg/mm²
70
65
60
55
50
45
YS/TS
.8
.7
.6
.5
.4
Low Yield Ratio Zone
El %
40
30
20
10
1
2
3
4
5
10
20
30
40
50
100
200
Secondary Cooling Rate R2 °C/sec.

PROCESS FOR PRODUCING HIGH-STRENGTH, LOW YIELD RATIO AND HIGH DUCTILITY DUAL-PHASE STRUCTURE STEEL SHEETS

BACKGROUND OF THE INVENTION

Field of the Invention

The present invention relates to high strength, low yield ratio and high ductility hot or cold rolled dual-phase structure steel sheet having excellent formability.

The low yield ratio used herein means the yield strength/tensile strength ratio which is about 0.6 or less, and the dual-phase structure used herein means a structure in which the main metallographic constituents are ferrite and a transformed phase produced by rapid cooling (such as martensite, or martensite plus bainite including some retained austenite).

In recent years, great efforts have been made in weight reduction of automobile cars mainly motivated by necessity of saving the fuel consumption.

As the thickness of steel materials used in automobile cars is decreased to reduce the weight, it becomes necessary to use a high strength steel in order to assure a satisfactory strength of the automobile cars.

Conventional high strength steels, however, have been limited in their applications due to their drawbacks such that they are confronted with the problem of "spring-back" during their press forming as they have an excessively high yield ratio and that as their work hardening rate (n value) is relatively low, localized strain-concentration takes place early during deformation (namely necking is caused), resulting in crackings.

Meanwhile, the present inventors developed high strength steel sheets free from yield elongation, with a maximum yield ratio (yield strength/tensile strength) of about 0.6, and excellent ductility as disclosed in Japanese Patent Laid-Open Specifications Sho 50-39210 and Sho 51-78730 (and related U.S. Pat. No. 4,062,700).

The steel sheets disclosed in the above Japanese Patent Laid-Open Specifications show a markedly lower yield ratio than the conventional high strength steels, as schematically shown by their stress-strain curves in FIG. 1 (this means less tendency to spring-back), and large work-hardening rate (n value) and elongation (thus less susceptible to cracking), and they can provide high yield strength when given slight strain (this means a high yield strength after forming) as apparently shown in FIG. 1. For these remarkable advantages in press forming, these steel grades are expected to be increasingly used. These steel grades are of dual-phase structure mixed with the ferrite phase and the transformation phase produced by rapid cooling (hereinafter "rapidly cooled transformation phase"), and their maximum limit of yield ratio demanded by users is 0.6.

Now the prior inventions made by the present inventors and disclosed in the aforementioned Japanese Patent Laid-Open Specifications, relate to a process which comprises continuous annealing of a Si-Mn steel containing about 1% Si and about 1.5% Mn in the two-phase ($\alpha+\gamma$) temperature zone (Sho 50-39210) or a process which comprises continuous annealing of an ordinary steel containing about 0.1 to 0.15% C and about 1.5% Mn in the two-phase ($\alpha+\gamma$) temperature zone, preceded by either (1) pre-annealing of the steel in the two-phase ($\alpha+\gamma$) temperature zone or (2) hot rolling the steel with its finishing temperature maintained in the two-phase ($\alpha+\gamma$) temperature zone and coiling at a desired temperature (Sho 51-78730). The features of the prior inventions, such as the high Si-Mn contents (Sho 50-39210), the pre-annealing in the two-phase temperature zone, or the hot roll finishing in the two-phase temperature zone (Sho 51-78730) are for the purposes of increasing the hardenability of the $\gamma$ phase formed in the steel during the continuous annealing in the two-phase ($\alpha+\gamma$) temperature zone, and thus resulting in a successful dual-phase structure after the eventual cooling.

In the prior inventions, the conditions of cooling after the continuous annealing are so specified that a relatively slow cooling rate should be applied so as to avoid damages on the ductility and shape of the steel sheet. However, regarding the cooling pattern, namely the cooling curve, these prior inventions are based on an ordinary simple cooling pattern, and do not take any special consideration to the cooling pattern. Further the prior inventions are suitable for obtaining a high strength dual-phase structure steel with a minimum tensile strength of about 60 kg/mm$^2$ and not suitable for production of steels with tensile strengths of 40 to 50 kg/mm$^2$ which have been strongly sought for by the automobile industry because these steel grades are usuable in a very wide field of applications.

SUMMARY OF THE INVENTION

The present invention, contrary to the prior inventions, has its main feature in that the cooling curve namely the cooling pattern, after the continuous annealing in the two-phase ($\alpha+\gamma$) temperature zone is arranged so as to obtain a dual-phase structure steel with improved properties. According to the present invention, it is possible not only to produce dual-phase structure steels with tensile strengths from 40 to 50 kg/mm$^2$ and yield ratios less than 0.6, but also to improve the material quality of dual-phase structure steels with tensile strengths of about 60 kg/mm$^2$, or more.

The features of the present invention will be described hereinbelow in comparison with the prior arts.

When a dual-phase structure steel composed of the ferrite phase and the rapidly cooled transformation phase is to be obtained by heating a hot or cold rolled steel sheet containing carbon and manganese in certain amounts as essential elements in the two-phase ($\alpha+\gamma$) temperature zone so as to partition the structure into the ferrite phase and the austenite phase, followed by a rapid cooling of the steel sheet, it has been believed according to the prior arts that as the cooling rate in the cooling step following the heating in the two-phase temperature zone increases, the martensitic transformation of the austenite phase is more satisfactorily attained and thus the more optimized dual-phase structure steel can be obtained. Therefore, according to the prior arts, it has been a common practice to apply a cooling rate as large as possible, so far as it does not damage the shape and ductility of the steel sheet. However, regarding the cooling pattern after the continuous annealing, namely, as for the relationship between the form of the cooling curve and the material quality of the steel obtained after the continuous annealing, no particular consideration has been taken by the prior arts so far as the dual-phase structure steel is concerned.

Contrary to the prior arts, according to the present invention, the steel is cooled relatively slowly from the temperature $T_1$° C. in which the two phases of $\alpha$ and $\gamma$ coexist to a certain temperature T° C. in the course of cooling process, and somewhat rapidly cooled below T° C. to a temperature $T_2$° C. of 200° C. or lower where the rapidly cooled transformation phases can fully be formed. It has been found that the material quality evaluated from the low yield ratio, the high ductility and the high tensile strength can be markedly improved by the cooling pattern employed in the present invention as compared with the prior arts in which the cooling rate in the whole cooling process is uniformly increased.

As understood from the above description, the main feature of the present invention lies in that the cooling pattern after the continuous annealing is improved and thereby the steel is effectively converted into a dual-phase structure. However, within the scope of the present invention, preliminary treatments, such as (a) coiling the hot rolled steel or strip at a high temperature not lower than 670° C. or (b) finish rolling in the two-phase ($\alpha+\gamma$) temperature zone in the hot rolling process of the starting material may be done. These preliminary treatments contribute to thermally stabilize the low yield ratio of the resultant dual-phase structure steel sheet.

Hereinbelow, more detailed description will be made on this point. For the production of dual-phase structure steels using a continuous annealing furnace, the furnace is very often used commonly for the production of cold rolled steel sheets for general purposes, and in this case, it is unavoidable to pass the steel sheet through an over-ageing reheating zone (the apparatus adopting the cooling pattern according to the present invention may also be used commonly for production of ordinary cold rolled steel sheet for general purposes, and in such a case, it should be understood that the over-ageing reheating zone is provided).

In the production of dual-phase structure steels, it is desirable for the formation of rapidly cooled transformation phase that the steel sheet passes as quickly as possible through the zones near the over-ageing temperature (namely near the temperature at which the rapidly cooled transformation phase is formed) applied to the production of ordinary cold rolled steel sheets and therefore some means such as for cutting off the heat supply to the over-ageing reheating zone may be provided. However, it is not permitted in most cases to wait until the over-ageing zone (furnace body) is cooled enough from the production efficiency of the furnace, and the steel sheet is subjected to reheating between 250° and 300° C. for several minutes max. or to shelfing due to the remaining heat in the over-ageing zone. For this reason, even when the rapid cooling is achieved before the steel sheet reaches the over-ageing zone, the final formation of the rapidly cooled transformation phase is rendered insufficient due to the passage through the overageing zone, so that the yield ratio is not satisfactorily lowered. (The low yield ratio of dual-phase structure steels is considered to be attributed to the internal stress induced into ferrite matrix, and to the mobile dislocations generated in the ferrite matrix, both of which are due to the formation of a rapidly cooled transformation phase, such as martensitic transformation. Therefore, when the formation of the rapidly cooled transformation phase is insufficient, it is difficult to achieve a low yield ratio.) However, it has been found that when the preliminarily treatments as mentioned hereinbefore are applied, the yield ratio can be lowered enough even in the case where the steel sheet is passed through the over-ageing reheating zone. In the prior invention (Japanese Patent Laid-Open Specification Sho 51-78730), a similar preliminary treatment is proposed, but in the present invention, the preliminary treatment is combined with a specific cooling pattern so as to produce the new and remarkable result that the yield ratio of a dual-phase structure steel sheet is thermally stabilized.

As a prior art which seems at first glance to be similar to the present invention, Japanese Patent Publication Sho 52-15046 (and related British Pat. No. 1,419,704) discloses a method for continuous annealing of a cold rolled steel sheet. This prior art method was developed for improving the press formability and the resistance to ageing at room temperature of an ordinary cold rolled steel sheet, and the inventive idea of this prior art lies in that the starting temperature of a rapid cooling after a continuous annealing is combined with the subsequent over-ageing reheating treatment so as to precipitate the solute carbon in ferrite in a state suitable for a press-formable steel. As far as understood from the disclosure and the examples, this prior art method can be applied apparently only to the extra-low-carbon steels, such as Al-killed steels, rimmed steels and capped steels, namely steel grades having a basic chemical composition containing about 0.05% C and about 0.3% Mn, and it is very natural that this prior art method is directed to the treatment to dispose the carbon in solution in the ferrite grains.

Contrary to this prior art method, the present invention is directed to a press-formable high strength steel sheet and not directed to an ordinary press-formable steel sheet and the inventive idea of the present invention lies in that the austenite phase formed during the continuous annealing in the two-phase ($\alpha+\gamma$) temperature zone is effectively converted into the rapidly cooled transformation phase, and for assuring the hardenability of the austenite, a minimum manganese content of 0.8% is defined as the lower limit in the steel composition, while no consideration is made for controlling the precipitation of the solute carbon in the ferrite.

The above technical differences between the present invention and the prior art method may be well illustrated by the following facts. In the prior art method as disclosed in the Japanese Patent Publication Sho 52-15046, the over-ageing treatment (at least for 30 seconds between 300° and 500° C.) is defined as an essential step. Contrary to this, in the present invention, an over-ageing treatment is harmful and should be avoided if possible. As mentioned hereinbefore, the steel sheet is passed through the over-ageing zone only from an unavoidable operational reason.

Another prior art which also seems at first glance somewhat similar to the present invention is Belgian Patent Publication No. 854,191. This requires 25° to 180° C./second, preferably 35° to 150° C./second as $R_1$, and 90° to 500° C./second, preferably 150° to 450° C./second as $R_2$. T is limited in the range of 200° C.$\leqq$T$\leqq$520° C., preferably 200° to 425° C. In contrast to this, the present invention requires 1° to 30° C./second, preferably 1° to 25° C./second (which will be described later) as $R_1$, and 4° to 100° C./second, preferably 4° to 90° C./second (which will also be described later) as $R_2$, and 420° to 700° C., preferably 440° to 680° C. (which will also be described later) as T. Differences in these parameters between the prior art and the present invention is quite obvious. The present invention has a great advantage in resultant ductility, by defining both $R_1$ and $R_2$ to be in the ranges of much slower cooling, and T in a higher side, compared to the prior art. The technological background of the present invention lies in the maximum enrichment of austenite with carbon during cooling in the stage at $R_1$ and $R_2$, avoiding the pearlite formation at the same time. This will be described later in more detail.

DETAILED DESCRIPTION OF THE INVENTION

The present invention will be described in more details by reference to the attached drawings.

BRIEF EXPLANATION OF THE DRAWINGS

FIG. 5 is a graph showing the relation between the cooling conditions after the continuous annealing of steel A (cold rolled sheet) and the resultant material quality.

In FIG. 3 showing the heating cycle pattern in the continuous annealing disclosed in Japanese Patent Publication Sho 52-15046, $T_1$ represents the maximum heating temperature, $T_2$ represents the temperature at which the rapid cooling starts, and during the period between $t_1$ and $t_2$ ($t_1 \rightarrow t_2$) the steel is slowly cooled or maintained at the temperature during which the carbide is dissolved and the carbon is dissolved in solid solution in the ferrite. Then, when the steel is rapidly cooled from $T_2$, the solute carbon in the ferrite is maintained so as to effect efficiently the subsequent carbide precipiration treatment ($T_4 \rightarrow T_5$, $t_4 \rightarrow t_5$).

Figure 1:
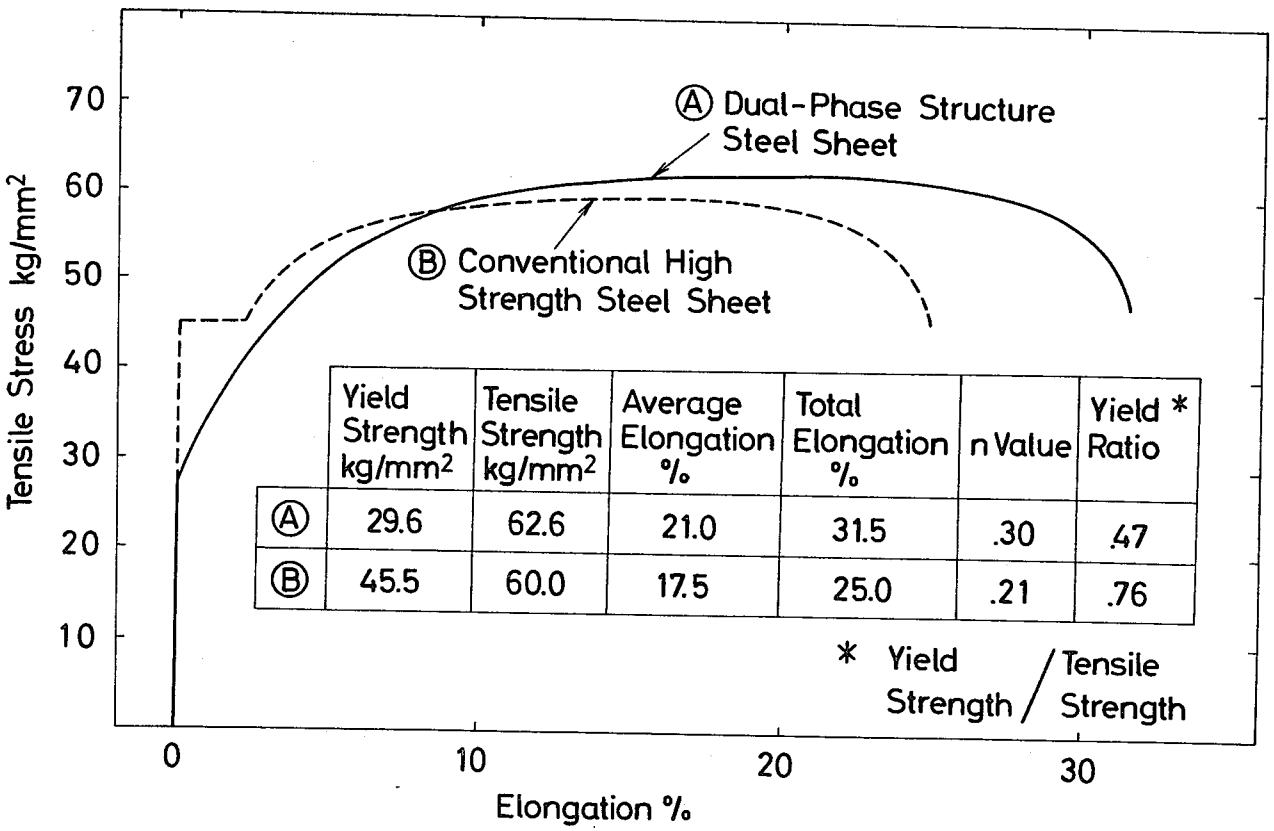
FIG. 1 is a graph showing comparison in various properties between the dual-phase structure steel sheet according to the present invention and a conventional high strength steel sheet.
Figure 2:
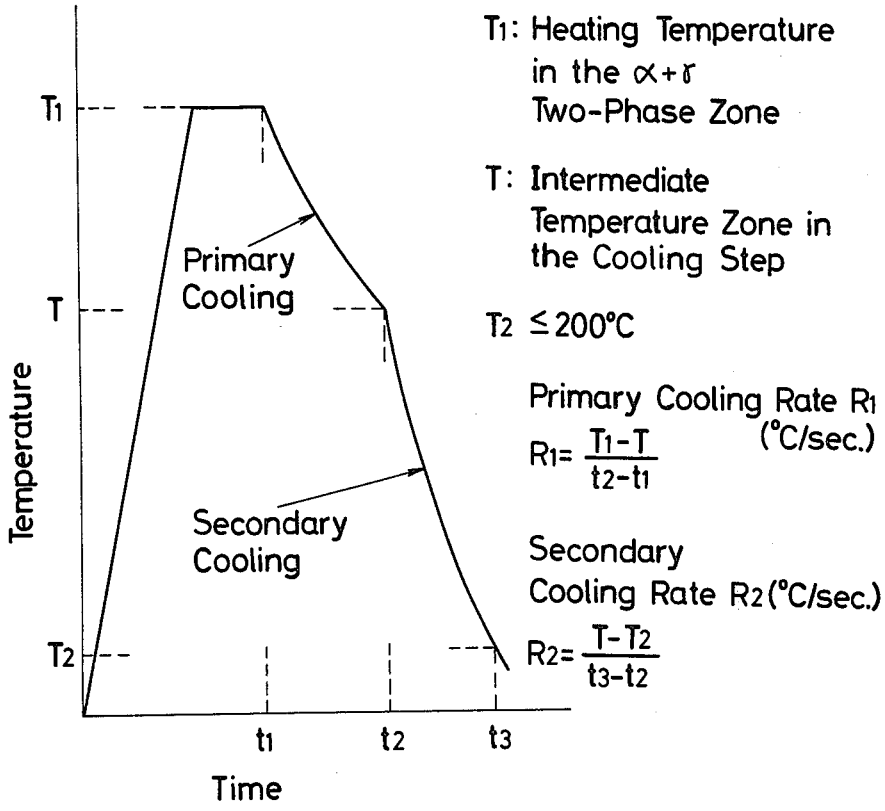
FIG. 2 is a graph showing the continuous annealing cycle according to the present invention.
Figure 3:
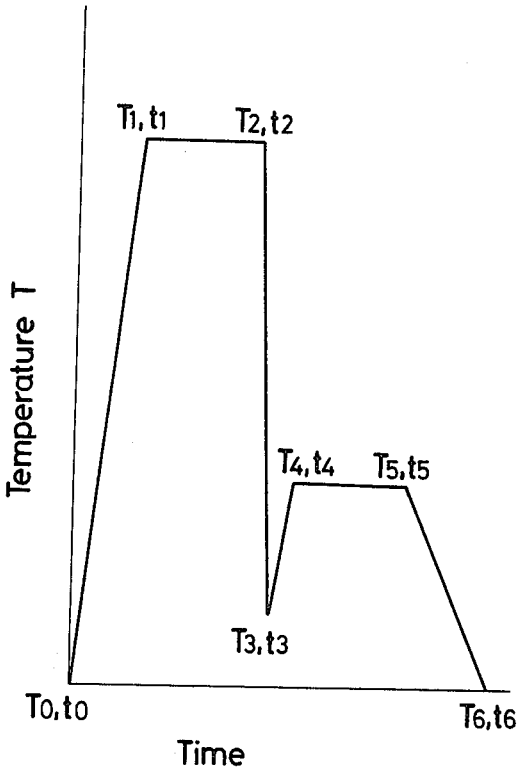
FIG. 3 is a graph showing the continuous annealing cycle disclosed in the Japanese Patent Publication Sho 52-15046.

Now, the heating cycle according to the present invention is as shown in FIG. 2, in which at the temperature $T_1$ the structure is partitioned into the $\alpha$ phase and the $\gamma$ phase, with some solute carbon in the $\alpha$ phase. During the cooling from the holding temperature $T_1$ with the primary cooling rate $R_1$, namely $T_1 \rightarrow T_2$ and $t_1 \rightarrow t_2$, the solute carbon in the $\alpha$ phase can largely be concentrated into the non-transformed $\gamma$ phase so as to stabilize the $\gamma$ phase. If the intermediate temperature T is too high, the concentration becomes insufficient, while on the other hand if the temperature is too low, the $\gamma$ phase transforms into a fine pearlite phase. Therefore, the intermediate temperature should be maintained in a suitable range, namely 420° C.$\leqq$T$\leqq$700° C. If the primary cooling rate $R_1$ is excessively large, the diffusion by which the carbon in the $\alpha$ phase transfers into the $\gamma$ phase is inhibited. Therefore, the primary cooling is desirably maintained toward a slow side. However, if the primary cooling rate $R_1$ is too small, the transformation of the $\gamma$ phase into pearlite is started prematurely at a relatively high temperature in the cooling process, thus causing a marked reduction of the proportion of the $\gamma$ phase which can form the final rapidly cooled transformation phase. Therefore, the primary cooling rate $R_1$ should be maintained within the range of 1° C./second$\leqq R_1 \leqq$30° C./second, preferably 1° C./second$\leqq R_1 \leqq$25° C./second in view of FIG. 8 which indicates that increasing in $R_1$ up to 25° C./second shows a slight decrease in elongation.

Figure 7:
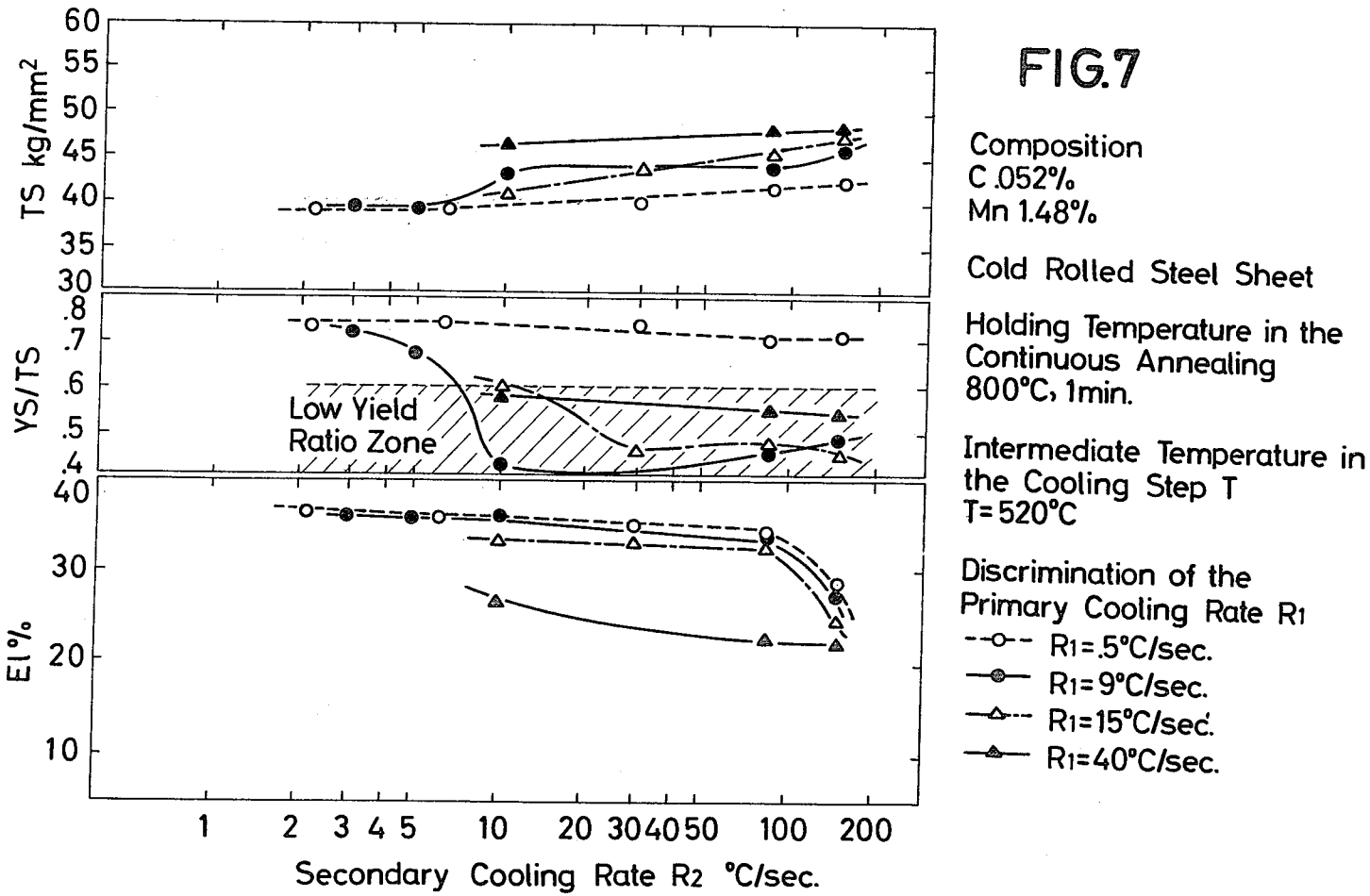
FIG. 7 is a graph showing the various properties obtained by various primary cooling rates $R_1$ and secondary cooling rates $R_2$ after the continuous annealing of steel A.

Subsequently, the $\gamma$ phase still remaining at the temperature T is rapidly cooled to the temperature $T_2$ or lower so as to convert the $\gamma$ phase into a rapidly cooled transformation phase ($T_2$ is a temperature at which the rapidly cooled transformation phase is fully achieved to form, namely 200° C.). Therefore, the secondary cooling rate $R_2$ should be maintained toward a higher side. If the secondary cooling rate $R_2$ is too small, the rapidly cooled transformation phase is not achieved to form and the phase results in fine pearlite. On the other hand, if the rate $R_2$ is too high, the solute carbon in the ferrite at T is maintained, causing lowered ductility, and damaging the sheet shape due to the thermal stress. Therefore, the secondary cooling rate $R_2$ should be maintained within the range of 4° C./second$\leqq R_2 \leqq$100° C./second, considering the elongation results shown in FIG. 7 and FIG. 8, 4° C./second$\leqq R_2 \leqq$90° C./second is preferable since $R_2$ at 100° C./second is marginal to a degraded elongation.

Further, if the condition of $R_1 < R_2$ is given, the transformation of the $\gamma$ phase remaining at the temperature T is much more completed than when the cooling rate below the intermediate temperature T is maintained equal or less than $R_1$ (namely $R_1 \geqq R_2$).

As understood from the foregoing descriptions, the principle of the present invention is that in the production of a dual-phase structure steel by heating in the two-phase ($\alpha+\gamma$) temperature zone followed by cooling, the cooling pattern should be designed in such a way that the higher temperature portion and the lower temperature portion in the cooling process have different functions; the higher temperature portion is directed to the concentration of carbon into the $\gamma$ phase, while the lower temperature portion is directed to achievement of the formation of the rapidly cooled transformation phase.

The ranges for the intermediate temperature $T_1$, the primary cooling rate $R_1$ and the secondary cooling rate $R_2$ have been defined through experiments so as to meet with the requirements of low yield ratio and high ductility as will be understood from the examples set forth hereinafter.

Figure 4:
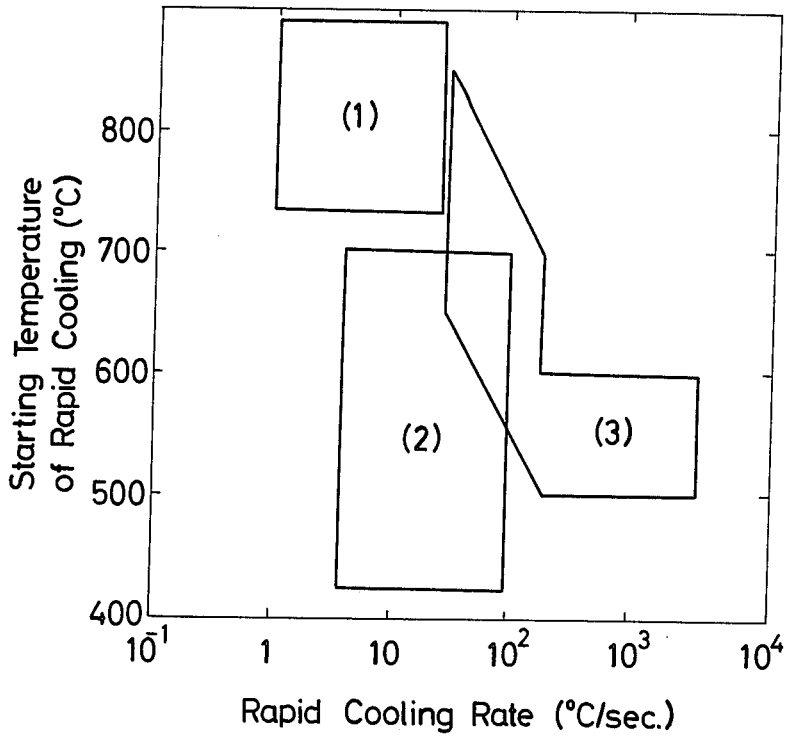
FIG. 4 is a graph showing the relation between the cooling rate and the starting temperature of cooling according to the present invention in comparison with the prior art method disclosed in Japanese Patent Publication Sho 52-15046.

From FIG. 4 showing the relation between the rapid cooling rate and the starting temperature of the rapid cooling disclosed in Japanese Patent Publication Sho 52-15046 in comparison with the relation between the cooling rate and the starting temperature of the rapid cooling according to the present invention, it will be clearly understood that the present invention is quite different from the prior art method in respect to the technical thoughts, objects and results.

DESCRIPTION OF PREFERRED EMBODIMENT

The present invention will be better understood from the following examples.

EXAMPLE 1

An Al-killed steel having a chemical composition as shown in Table 1 is subjected to an ordinary finishing hot rolling (finishing temperature=900° C.) and coiled at 550° C. to obtain a hot rolled steel strip of 2.7 mm thick, and this hot rolled steel strip is further subjected to cold rolling with 70% reduction into a cold rolled steel strip of 0.8 mm thick. The cold rolled steel strip is subjected to the heating in the $(\alpha+\gamma)$ two-phase zone and cooling under the continuous annealing conditions shown in Table 2. The resultant properties are shown in the same table.

The relation between the cooling conditions and the resultant properties is clearly shown in FIG. 5, which graphs the results shown in Table 2. The adjustment of the cooling conditions are performed by controlling the cooling of air jet stream. The cooling condition (1) represents a monotonous cooling pattern in which the average cooling rate from 800° C. to 200° C. is 4.3° C./second, and the cooling condition (2) also represents a monotonous cooling pattern in which the cooling rate from 800° C. to 200° C. is 15° C./second, both representing the cooling patterns according to the prior arts. Meanwhile, the cooling condition (3) represents a cooling pattern in which the primary cooling rate $R_1$ down to the intermediate temperature T (500° C.) is 9° C./second, and the secondary cooling rate $R_2$ from 500° C. down to 200° C. is 10° C./second. To describe in more details, the cooling rate from 800° C. down to 500° C. is the same as the condition (1) and the cooling rate from 500° C. down to 200° C. is the same as the condition (2). If the cooling rate over the whole cooling process from 800° C. down to 200° C. is averaged, the average rate is 9.4° C./second which is an intermediate rate between the condition (1) and the condition (2). Therefore, supposing from the conventional knowledge and experience, it is predicted that the tensile strength increases, the yield strength lowers (because it is generally considered that the rapidly cooled transformation phase is more easily formed as the average cooling rate for the whole cooling process increases) and the elongation decreases according to the order of the conditions (1)→(3)→(2) based on the order of the average cooling rates for the whole cooling process.

Contrary to this prediction the results shown that the tensile strength is the highest and the yield strength is the lowest (hence the yield ratio is the lowest) yet with high ductility maintained under the condition (3).

EXAMPLE 2

Figure 6:
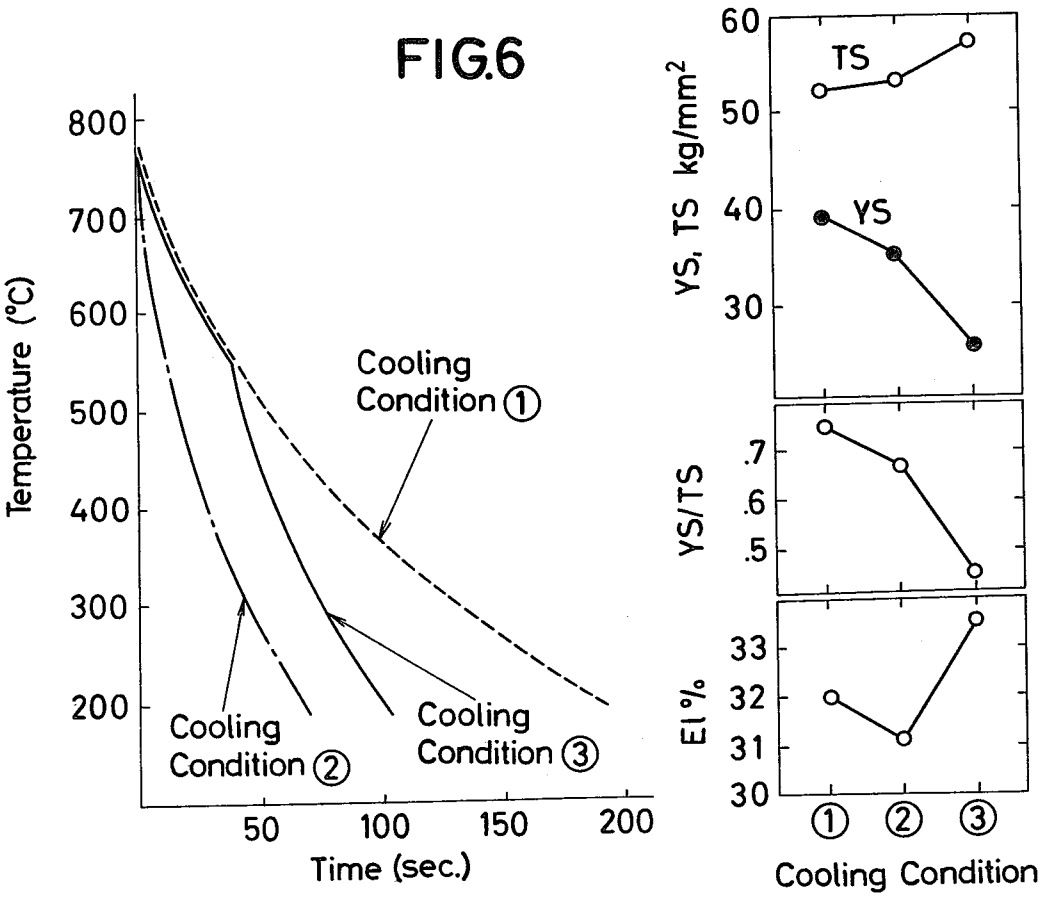
FIG. 6 is a graph showing the relation between the cooling conditions after the continuous annealing of steel B (hot rolled sheet) and the resultant material quality.

An Al-Si killed sheet B having a chemical composition shown in Table 3 is subjected to an ordinary finishing hot rolling (finishing temperature=880° C.) and coiled at 620° C. to obtain a hot rolled steel strip of 1.6 mm thick, which is directly further subjected to the heating in the two-phase $(\alpha+\gamma)$ zone and cooling under the conditions shown in Table 4. The resultant properties are shown in the same table. The relation between the cooling conditions and the resultant properties is shown in FIG. 6. As clearly shown by the results, the best material quality of a dual-phase structure steel can be obtained when the cooling condition (3) which is within the scope of the present invention is applied, just as in the case of a cold rolled steel sheet in Example 1.

EXAMPLE 3

The cold rolled steel sheet obtained in Example 1 and the hot rolled steel sheet obtained in Example 2 are respectively cooled in the cooling step following the continuous annealing with various primary cooling rates $R_1$ and secondary cooling rates $R_2$ with the intermediate temperature T being set at 520° C. or 530° C. The results are shown in Table 5 and Table 6. The adjustment of the cooling rate is effected in most cases by controlling the air jet stream. However, a jet stream of a mixture of air and water mist may be used when a larger cooling rate is desired or some additional steel sheets may be overlapped when a smaller cooling rate is desired. The results in Table 5 has been graphed in FIG. 7, and the results in Table 6 are graphed in FIG. 8.

Figure 8:
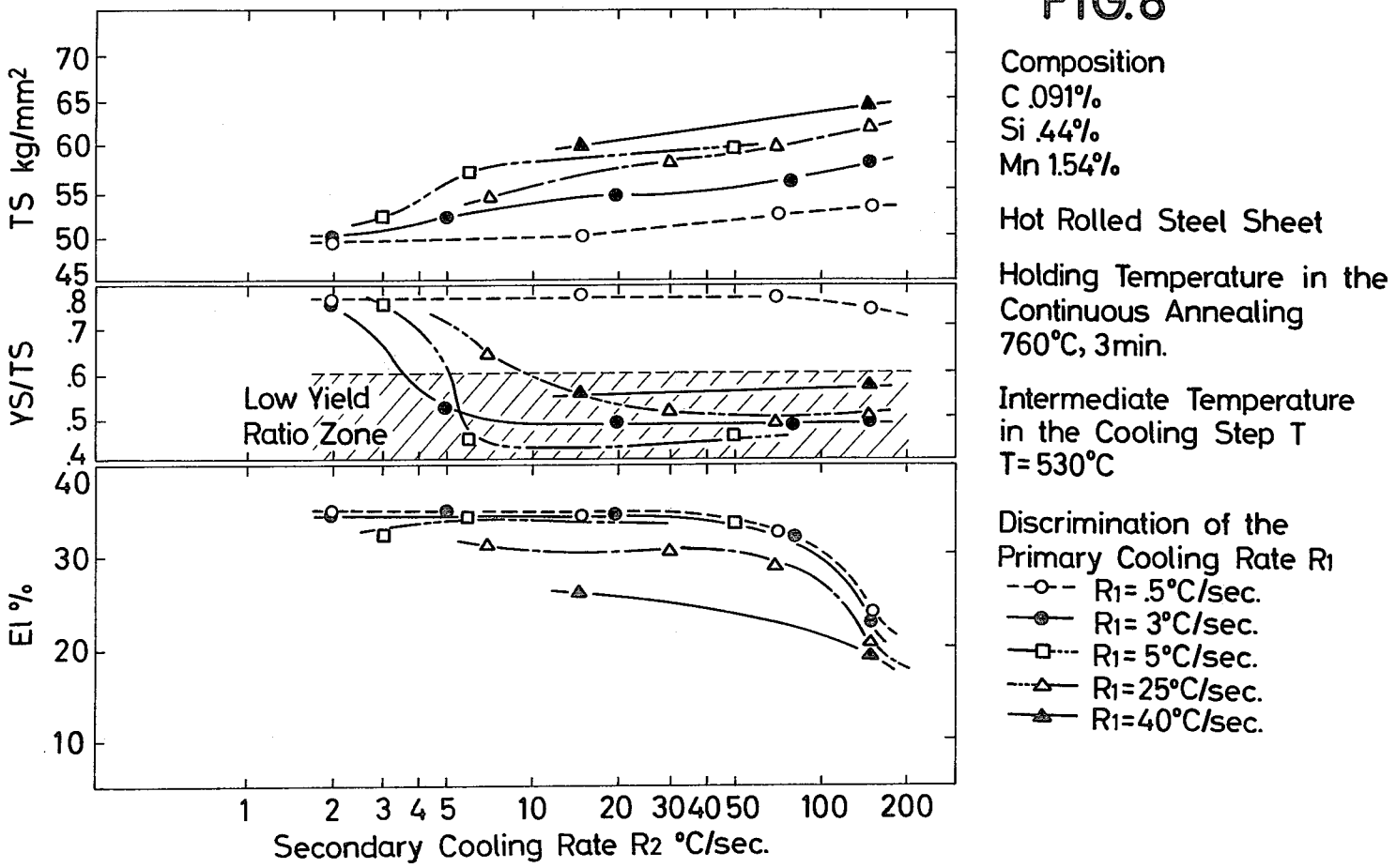
FIG. 8 is a graph showing the properties obtained by various primary cooling rates $R_1$ and secondary cooling rates $R_2$ after the continuous annealing of steel B.

In either of these graphs, when the cooling rate $R_1$ is 0.5° C./second, it is impossible to obtain a low yield ratio irrespective of the secondary cooling rate $R_2$. On the other hand, when the cooling rate $R_1$ reaches 40° C./second, it is possible to obtain a low yield ratio, but the elongation is markedly deteriorated. From the above results, the primary cooling rate $R_1$ is defined within the range of 1° C./second $\leqq R_1 \leqq$ 30° C./second. Regarding the secondary cooling rate $R_2$, the yield ratio lowers markedly when $R_1 < R_2$ and the lower limit of $R_2$ is defined 4° C./second from the example (FIG. 8). On the other hand, when the secondary cooling rate $R_2$ reaches 150° C./second, the elongation lowers irrespective of $R_1$. Therefore, the secondary cooling rate R2 should satisfy the condition of 4° C./second $\leqq R_2 \leqq$ 100° C./second and $R_1 < R_2$.

EXAMPLE 4

Figure 9:
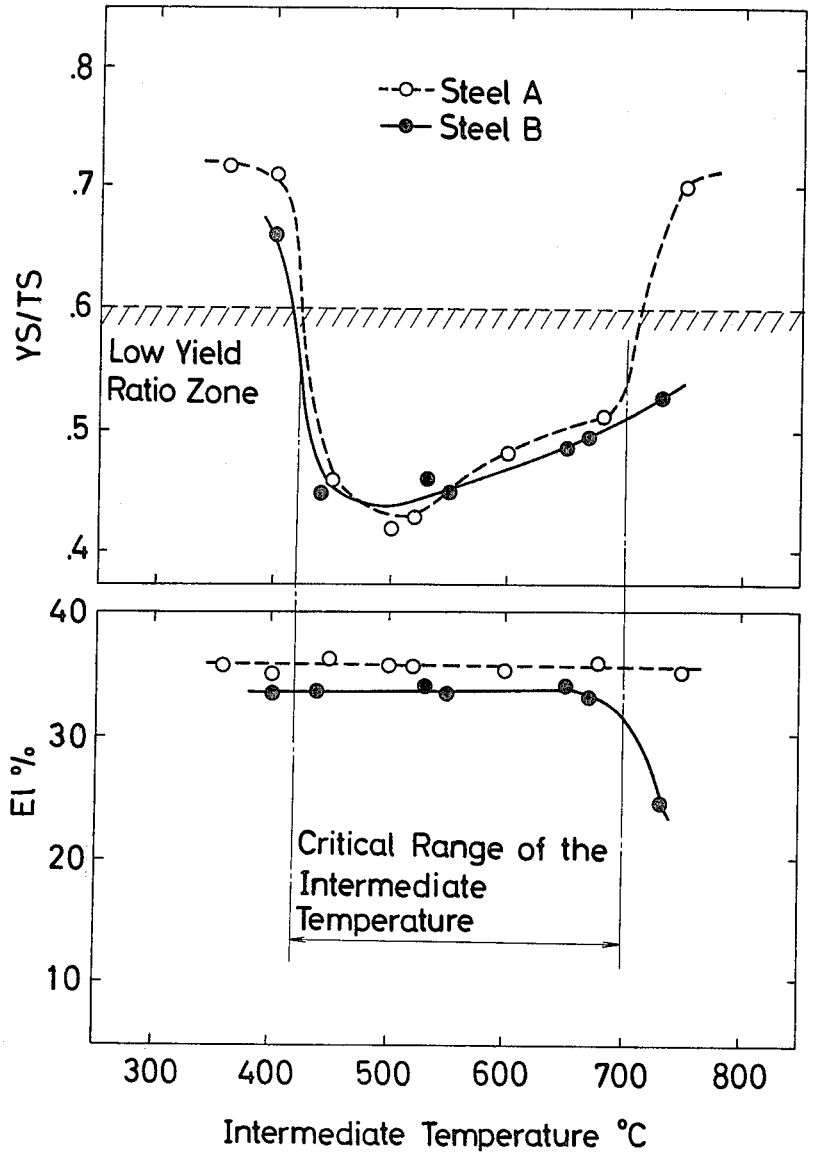
FIG. 9 is a graph showing the properties obtained by the various intermediate temperature T which is a dividing point between the primary cooling and the secondary cooling in the continuous annealing process of steels A and B.

The same steel sheets as used in Example 3 are subjected to the continuous annealing and cooling process with various intermediate temperatures T, and the results are shown in Table 7 and FIG. 9. When the intermediate temperature T is not higher than 400° C., a desired low yield ratio can not be obtained, but when it is higher than 700° C., the elongation deteriorates or a low yield ratio can not be obtained. Therefore, the intermediate temperature should be defined as 420° C. $\leqq T \leqq$ 700° C. from the results shown in FIG. 9, and preferably 440° C. $\leqq T \leqq$ 680° C. from the data shown in Table 7.

EXAMPLE 5

Figure 10:
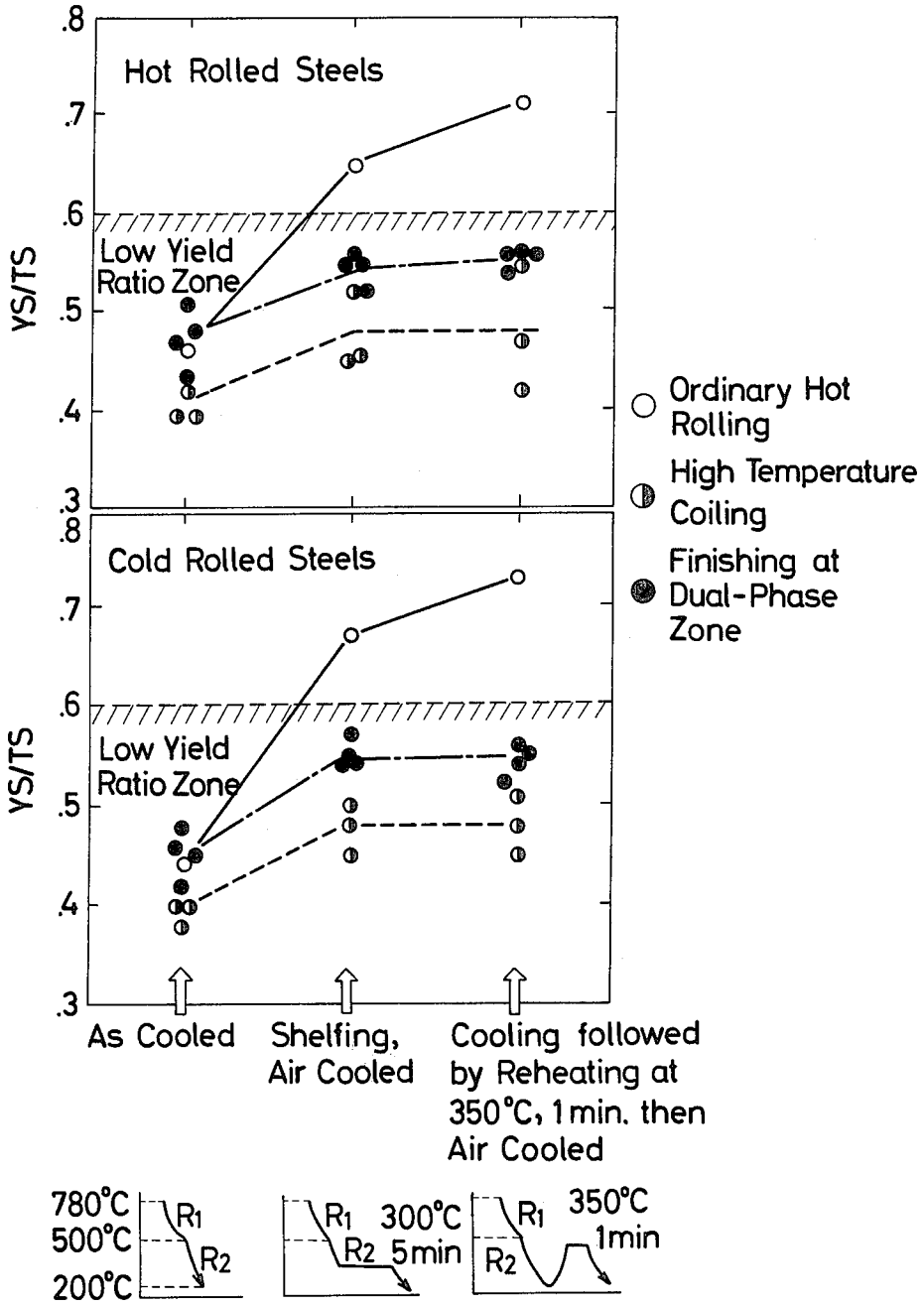
FIG. 10 is a graph showing effects of the shelfing and the low temperature reheating in the continuous annealing-cooling process of steel C (hot rolled and cold rolled) on the resultant yield ratio.

Hot rolled low carbon steel sheets are produced with various finishing hot rolling and coiling conditions, and directly or after cold rolling, subjected to the $(\alpha+\gamma)$-two-phase continuous annealing and cooling process, changes in the material properties due to the short-time reheating not higher than 350° C. or the shelfing are determined. The results are shown in Table 8, and the changes in yield ratio are particularly shown in FIG. 10.

When the hot rolling is done with the ordinary finishing and coiling conditions, the yield ratio increases to 0.6 or larger due to the short-time reheating or the shelfing, but when the coiling is done at higher temperatures or the rolling is finished in the $(\alpha+\gamma)$two-phase zone, lower yield ratios less than 0.6 are assured for the following reasons. The high temperature coiling or the($\alpha+\gamma$)two-phase zone finishing in the hot rolling provides the pearlite phase (or cementite) in which C and Mn have already been concentrated prior to the continuous annealing, and at the time when these phases are reheated in the($\alpha+\gamma$)two-phase zone and transformed back into the $\gamma$ phase, C and Mn have been already considerably concentrated in the $\gamma$ phase. In addition the concentration into the $\gamma$ phase of the constituents is further promoted during the primary cooling step. Therefore, the final rapid cooling transformation phase, particularly the martensite would become more like a twinned martensite (which is formed when a relatively high constituent $\gamma$ phase is rapidly cooled) rather than a lath martensite (which is formed when a relatively low constituent $\gamma$ phase is rapidly cooled, and contains a high density of dislocations), so that the decomposition of the martensite at about 300° C., namely the carbide precipitation in the martensite phase, is retarded. The carbide precipitation is prone to take place at the dislocations as precipitation nuclei, so that the decomposition of the martensite at about 300° C. would be effected in a shorter time in a lath martensite with a high density of dislocations while the decomposition would take a longer time in the twinned martensite. This example indicates that the high temperature coiling or the($\alpha+\gamma$)two-phase zone finishing in the hot rolling is effective to stably maintain the yield ratio of a dual-phase structure steel produced by a continuous annealing and cooling at lower values even when a rapid cooling in a temperature range of not higher than 350° C. can not be achieved. The lower limit of the high temperature coiling is set at 670° C. below which no desirable effect is developed as shown in Table 8. On the other hand, when the coiling temperature exceeds 780° C., excessive coarsening of the grains and difficulties in the subsequent descaling step are caused. Therefore, the upper limit is set at 780° C. In the case where the finishing in the($\alpha+\gamma$)two-phase zone is performed, the upper limit of the finishing temperature is set at 820° C. and the lower limit is set at 720° C. as a markedly effective range as illustrated in Table 8. Even below 720° C., the effect still remains, but the rolling load in the rolling is sharply increased. Therefore, the lower limit should be at 720° C.

It is clearly understood from this example that it is necessary to apply the high temperature coiling or the-($\alpha+\gamma$)two-phase zone finishing as an auxiliary means when the present invention is applied to a continuous annealing device having an over-ageing zone as mentioned hereinbefore, and, at the same time, it is not necessary to cool down to 200° C. or below at the rate $R_2$, but it is sufficient to cool with $R_2$ down to 350° C. or below.

EXAMPLE 6

Various properties of steel sheets with different contents of C, Si and Mn after continuous annealing are shown in Table 9. When the carbon content is 0.02% and the manganese content is 0.5%, the desired low yield ratio can not be obtained. As illustrated by the embodiments of the present invention, 0.03% or more of carbon and 0.8% or more of Mn are necessary to obtain a dual-phase structure. However, when C and Mn are present in excessive amounts the weldability tends to be degraded. Therefore, the upper limit of C is set at 0.12% and that of Mn is set at 1.7%. Meanwhile, when 0.9% or more of Si is contained and enough amounts of C and Mn are contained (steels J and K in Table 9), a dual-phase structure is fully achieved already by the simple cooling following the continuous annealing, and therefore even if the cooling pattern according to the present invention is applied, no further marked effect in lowering the yield ratio or no further improvement in tensile strength and elongation can be obtained. Thus, in the present invention it is sufficient if the Si content satisfies the condition of Si≦0.8%. The steel used in the present invention may be produced in an open hearth, a converter, an electric furnace or the like, and when a relatively low carbon steel is desired, a vacuum degassing treatment may be applied. Further, the steel may be a rimmed steel, a capped steel, a semi-killed steel or a killed steel. When improved formability, such as severe bending property is required, 0.05% or less of one or more of rare earth metals, Zr and Ca may be added so as to control the shape of sulfide non-metallic inclusions. As for the casting method, an ordinary ingot casting method or a continuous casting method may be applied.

As understood from the foregoing descriptions, it is possible according to the present invention to produce a dual-phase structure steel having a low yield ratio, a high tensile strength and a high ductility from a relatively low-alloy C-Mn steel. As described hereinbefore, the range for the continuous annealing temperature in the present invention coinsides with the temperature range in which the two-phase of($\alpha+\gamma$)exists in the specific steel composition, namely the range from 730° to 900° C.

The present invention may be applied to a dual-phase structure steel on which a metal coating to be applied by hot dipping. In this case, the steel strip is passed through a portion of a hot dipping tank which is maintained at the intermediate temperature T bordering the primary cooling and the secondary cooling as shown in FIG. 2.

For example, in the case of zinc hot dipping, the hot dipping tank is normally maintained between 460° and 500° C. and the steel strip passes through the tank in several seconds. These operational conditions are very advantageous to the present invention, and what is more advantageous is that the steel composition specified in the present invention contains only a small amount of Si or does not contain Si which is detrimental to the zinc coating.

TABLE 1

| | Analysis of Steel A (by weight %) | | | | | |
|---|---|---|---|---|---|---|
| Steel | C | Si | Mn | P | S | Al |
| A | 0.052 | 0.01 | 1.48 | 0.010 | 0.007 | 0.023 |

Al-killed Steel, 0.8 mm thick, cold rolled.

TABLE 2

Continuous Annealing Conditions and Properties of Steel A

| Continuous Annealing | Cooling Conditions | YS kg/mm² | TS kg/mm² | El % | YS/TS | Remarks |
|---|---|---|---|---|---|---|
| 800° C. (1) 1 min. | 800° C.→200° C. Average Cooling Rate 4.3° C./sec. | 28.0 | 39.5 | 36.0 | 0.71 | Conventional Simple Cooling |
| 800° C. (2) 1 min. | 800° C.→200° C. Average Cooling Rate 15° C./sec. | 24.2 | 41.0 | 32.8 | 0.59 | Conventional Simple Cooling |

TABLE 2-continued

| Continuous Annealing Conditions and Properties of Steel A | | | | | | |
|---|---|---|---|---|---|---|
| Continuous Annealing | Cooling Conditions | YS kg/mm² | TS kg/mm² | El % | YS/TS | Remarks |
| 800° C. (3) 1 min. | 800° C.→500° C. $R_1$ = 9° C./sec. 500° C.→200° C. $R_2$ = 10° C./sec. | 18.5 | 43.5 | 35.7 | 0.42 | Cooling Pattern According to the Present Invention |

(YS: Yield Strength, TS: Tensile Strength, El: Elongation)

TABLE 3

| Analysis of Steel B (by weight %) | | | | | | |
|---|---|---|---|---|---|---|
| Steel | C | Si | Mn | P | S | Al |
| B | 0.091 | 0.44 | 1.54 | 0.012 | 0.005 | 0.026 |

Al-Si killed Steel, 1.6 mm thick, hot rolled.

TABLE 4

| Continuous Annealing Conditions and Properties of Steel B | | | | | | |
|---|---|---|---|---|---|---|
| Continuous Annealing | Cooling Conditions | YS kg/mm² | TS kg/mm² | El % | YS/TS | Remarks |
| 780° C. (1) 2 min. | 780° C.→200° C. Average Cooling Rate 3° C./sec. | 38.9 | 52.1 | 32.0 | 0.75 | Conventional Simple Cooling |
| 780° C. (2) 2 min. | 780° C.→200° C. Average Cooling Rate 8.5° C./sec. | 35.3 | 53.0 | 31.1 | 0.67 | Conventional Simple Cooling |
| 780° C. (3) 2 min. | 780° C.→550° C. $R_1$ = 4.8° C./sec. 550° C.→200° C. $R_2$ = 6° C./sec. | 25.7 | 57.2 | 33.5 | 0.45 | Cooling Pattern According to the Present Invention |

(YS: Yield Strength, TS: Tensile Strength, El: Elongation)

TABLE 5

| Changes in Cooling Condition after Continuous Annealing and Properties of Steel A | | | | | |
|---|---|---|---|---|---|
| 800° C.→520° C. Primary Cooling Rate $R_1$ °C./sec. | 520° C.→200° C. Secondary Cooling Rate $R_2$ °C./sec. | TS kg/mm² | YS/TS | El % | Remarks |
| | 2 | 38.5 | 0.73 | 36.5 | |
| | 6 | 39.0 | 0.74 | 36.3 | |
| 0.5 | 30 | 40.0 | 0.74 | 35.0 | |
| | 85 | 41.9 | 0.70 | 34.8 | |
| | 150 | 42.8 | 0.71 | 28.5 | |
| | 3 | 39.5 | 0.71 | 36.0 | |
| | 5 | 39.6 | 0.68 | 35.5 | |
| 9 | 10 | 43.4 | 0.43 | 35.6 | Present Invention |
| | 85 | 44.5 | 0.46 | 33.8 | Present Invention |
| | 150 | 46.0 | 0.49 | 27.5 | |
| | 10 | 41.1 | 0.61 | 33.0 | |
| | 30 | 44.0 | 0.47 | 32.8 | Present Invention |
| 15 | 85 | 45.5 | 0.48 | 32.5 | Present Invention |
| | 150 | 47.6 | 0.46 | 24.9 | |

TABLE 5-continued

| Changes in Cooling Condition after Continuous Annealing and Properties of Steel A | | | | | |
|---|---|---|---|---|---|
| 800° C.→520° C. Primary Cooling Rate $R_1$ °C./sec. | 520° C.→200° C. Secondary Cooling Rate $R_2$ °C./sec. | TS kg/mm² | YS/TS | El % | Remarks |
| | 10 | 46.5 | 0.58 | 26.5 | |
| 40 | 85 | 48.3 | 0.56 | 22.5 | |
| | 150 | 48.5 | 0.55 | 22.0 | |

Continuous Annealing : held at 800° C. for 1 min.
Intermediate Temperature T = 520° C.

TABLE 6

| Changes in Cooling Conditions after Continuous Annealing and Properties of Steel B | | | | | |
|---|---|---|---|---|---|
| 760° C.→530° C. Primary Cooling Rate $R_1$ °C./sec. | 530° C.→200° C. Secondary Cooling Rate $R_2$ °C./sec. | TS kg/mm² | YS/TS | El % | Remarks |
| | 2 | 49.0 | 0.75 | 34.5 | |
| | 15 | 49.8 | 0.77 | 34.0 | |
| 0.5 | 70 | 52.5 | 0.77 | 32.3 | |
| | 150 | 53.0 | 0.74 | 23.9 | |
| | 2 | 49.8 | 0.74 | 33.5 | |
| | 5 | 52.0 | 0.53 | 34.6 | Present Invention |
| 3 | 20 | 54.9 | 0.49 | 34.1 | Present Invention |
| | 80 | 56.0 | 0.48 | 32.0 | Present Invention |
| | 150 | 57.9 | 0.49 | 22.5 | |
| | 3 | 52.4 | 0.75 | 31.9 | |
| 5 | 6 | 57.0 | 0.46 | 33.8 | Present Invention |
| | 50 | 59.8 | 0.47 | 33.2 | Present Invention |
| | 7 | 54.2 | 0.64 | 31.2 | |
| 25 | 30 | 58.0 | 0.52 | 30.5 | Present Invention |
| | 70 | 59.7 | 0.49 | 28.5 | Present Invention |
| | 150 | 62.0 | 0.51 | 20.1 | |
| | 15 | 60.0 | 0.55 | 25.6 | |
| 40 | 150 | 64.1 | 0.57 | 19.1 | |

Continuous Annealing : held at 760° C. for 3 minutes
Intermediate Temperature T = 530° C.

TABLE 7

| Changes in Intermediate Temperature T in Cooling Step after Continuous Annealing, and Properties of Steels A and B | | | | | |
|---|---|---|---|---|---|
| Steel A: Continuous Annealing: held at 800° C. for 1 min. | | | | | |
| Primary Cooling Rate $R_1$ °C./sec. | Intermediate Temp. T °C. | Secondary Cooling Rate $R_2$ °C./sec. | YS/TS | El % | Remarks |
| 8 | 360 | 15 | 0.72 | 35.5 | |
| 8 | 400 | 15 | 0.71 | 35.0 | |
| 10 | 450 | 15 | 0.46 | 36.5 | Present Invention |
| 9 | 500 | 11 | 0.42 | 35.5 | Present Invention |
| 9 | 520 | 12 | 0.43 | 35.4 | Present Invention |
| 7 | 600 | 18 | 0.48 | 35.4 | Present Invention |
| 4 | 680 | 12 | 0.52 | 35.6 | Present Invention |

TABLE 7-continued

Changes in Intermediate Temperature T in Cooling Step after Continuous Annealing, and Properties of Steels A and B

| | | | | | |
|---|---|---|---|---|---|
| 8 | 750 | 12 | 0.70 | 35.0 | |

Steel B: Continuous Annealing: held at 760° C. for 3 minutes

| Primary Cooling Rate $R_1$ °C./sec. | Intermediate Temp. T °C. | Secondary Cooling Rate $R_2$ °C./sec. | YS/TS | El % | Remarks |
|---|---|---|---|---|---|
| 7 | 400 | 10 | 0.66 | 33.5 | |
| 7 | 440 | 10 | 0.45 | 33.7 | Present Invention |
| 5 | 530 | 7 | 0.46 | 33.6 | Present Invention |
| 3 | 550 | 7 | 0.45 | 33.3 | Present Invention |
| 2 | 650 | 10 | 0.48 | 34.0 | Present Invention |
| 2 | 670 | 15 | 0.49 | 33.1 | Present Invention |
| 4 | 730 | 40 | 0.53 | 24.5 | |

TABLE 8

Effects of Low-Temperature Reheating and Shelfing on Properties of Steel C Hot-Rolled with Various Conditions and Continuously Annealed

| Composition os Steel C (by weight %) | C | Si | Mn | P | S | Al |
|---|---|---|---|---|---|---|
| | 0.083 | 0.32 | 1.40 | 0.011 | 0.006 | 0.035 |

| | Type | Hot Rolling: Finishing Temp. T °C. | Hot Rolling: Cooling T °C. | Continuous Annealing held at 780° C. for 2 min.: $R_1$ °C./sec. | T °C. | $R_2$ °C./sec. | As Cooled: TS kg/mm² | YS/TS | El % | Shelfing at 300°C. for 5 min. Air Cooling: TS kg/mm² | YS/TS | El % | After Cooling, heated at 350° C. for 1 min. Air Cool: TS kg/mm² | YS/TS | El % |
|---|---|---|---|---|---|---|---|---|---|---|---|---|---|---|---|
| Hot Rolled 2mm Thick | High Temp. | 920 | 780 | | | | 52.6 | 0.39 | 35.0 | 51.5 | 0.46 | 36.1 | 51.4 | 0.42 | 36.0 |
| | Cooling | 900 | 730 | | | | 53,8 | 0.39 | 35.5 | 52.6 | 0.45 | 36.1 | 52.7 | 0.47 | 36.2 |
| | | 880 | 670 | | | | 53.3 | 0.42 | 34.8 | 52.5 | 0.52 | 35.2 | 52.2 | 0.55 | 35.5 |
| | Ordinary | 880 | 600 | 5 | 500 | 8 | 52.4 | 0.46 | 34.5 | 51.0 | 0.65 | 35.0 | 50.9 | 0.71 | 35.4 |
| | Two-Phase Zone | 820 | 550 | | | | 54.7 | 0.48 | 34.7 | 53.2 | 0.55 | 35.2 | 53.1 | 0.54 | 35.0 |
| | | 780 | 530 | | | | 56.5 | 0.44 | 34.0 | 54.9 | 0.55 | 34.8 | 53.8 | 0.56 | 35.0 |
| | | 750 | 520 | | | | 57.8 | 0.47 | 32.3 | 56.2 | 0.52 | 33.9 | 56.2 | 0.56 | 33.8 |
| | Finish. | 720 | 500 | | | | 58.9 | 0.51 | 31.1 | 57.8 | 0.56 | 31.8 | 57.2 | 0.56 | 31.6 |
| 60% Cold Rolled 0.8mm Thick | High Temp. | 920 | 780 | | | | 55.2 | 0.38 | 34.2 | 53.9 | 0.45 | 35.0 | 53.3 | 0.45 | 35.1 |
| | Cool. | 900 | 730 | | | | 55.5 | 0.40 | 34.5 | 53.9 | 0.48 | 35.2 | 53.8 | 0.51 | 34.9 |
| | Ordinary | 880 | 670 | | | | 55.0 | 0.40 | 34.0 | 52.8 | 0.50 | 35.0 | 53.0 | 0.48 | 34.9 |
| | | 880 | 600 | 9 | 500 | 11 | 54.3 | 0.44 | 33.8 | 52.5 | 0.67 | 34.5 | 52.4 | 0.73 | 34.7 |
| | Two-Phase Zone | 820 | 550 | | | | 56.1 | 0.45 | 33.8 | 54.5 | 0.55 | 34.2 | 54.6 | 0.54 | 33.9 |
| | | 780 | 530 | | | | 58.3 | 0.48 | 33.0 | 55.9 | 0.54 | 33.8 | 55.2 | 0.56 | 33.8 |
| | | 750 | 520 | | | | 58.8 | 0.42 | 32.1 | 57.0 | 0.54 | 33.0 | 56.7 | 0.52 | 32.6 |
| | Finishing | 720 | 500 | | | | 58.6 | 0.46 | 31.0 | 56.9 | 0.57 | 32.2 | 56.5 | 0.55 | 32.2 |

TABLE 9

Properties of Various Steel Compositions as Continuously Annealed

| Steels | Constituents (by weight %) C | Si | Mn | Hot Rolling: Finish. Temp. °C. | Coiling Temp. °C. | Continuous Annealing: Holding Temp. & Time | $R_1$ °C./sec. | T °C. | $R_2$ °C./sec. | TS kg/mm² | YS/TS | El % | Remarks |
|---|---|---|---|---|---|---|---|---|---|---|---|---|---|
| D* | 0.02 | 0.02 | 1.35 | 900 | 700 | 800° C. 1 min. | Average | 15° C./sec. | Simple Cooling | 34.1 | 0.72 | 40.3 | |
| | | | | | | | 8 | 550 | 15 | 33.0 | 0.67 | 42.5 | |
| E* | 0.04 | 0.51 | 1.69 | 890 | 720 | 780° C. 1 min. | Average | 10° C./sec. | Simple Cooling | 44.7 | 0.57 | 34.2 | |
| | | | | | | | 8 | 500 | 10 | 46.8 | 0.40 | 35.5 | |
| F* | 0.09 | 0.32 | 0.54 | 900 | 700 | 800° C. 1 min. | Average | 10° C./sec. | Simple Cooling | 35.9 | 0.71 | 42.9 | |
| | | | | | | | 9 | 550 | 10 | 35.6 | 0.72 | 43.0 | |
| G | 0.08 | 0.45 | 0.90 | 910 | 740 | 850° C. 2 min. | Average | 13° C./sec. | Simple Cooling | 40.3 | 0.74 | 36.2 | |
| | | | | | | | 6 | 580 | 13 | 41.8 | 0.56 | 37.2 | |
| H | 0.10 | 0.73 | 1.30 | 880 | 690 | 820° C. 3 min. | Average | 8° C./sec. | Simple Cooling | 56.2 | 0.66 | 32.1 | |
| | | | | | | | 4 | 520 | 8 | 58.4 | 0.41 | 33.8 | |
| I | 0.09 | 0.02 | 1.70 | 870 | 620 | 770° C. 2 min. | Average | 6° C./sec. | Simple Cooling | 56.2 | 0.56 | 31.5 | |
| | | | | | | | 3 | 500 | 6 | 60.1 | 0.38 | 33.2 | |
| J | 0.11 | 0.93 | 1.55 | 890 | 600 | 800° C. 3 min. | Average | 6° C./sec. | Simple Cooling | 66.2 | 0.40 | 29.5 | |
| | | | | | | | 3 | 500 | 6 | 66.4 | 0.39 | 29.3 | |
| | | | | | | | Average | 9° C./sec. | Simple Cooling | 94.0 | 0.41 | 17.2 | |

TABLE 9-continued

| | | | | Properties of Various Steel Compositions as Continuously Annealed | | | | | | | | | |
|---|---|---|---|---|---|---|---|---|---|---|---|---|---|
| | Constituents (by weight %) | | | Hot Rolling Finish. Temp. | Hot Rolling Coiling Temp. | Continuous Annealing Holding Temp. & Time | Continuous Annealing $R_1$ °C./sec. | Continuous Annealing T °C. | Continuous Annealing $R_2$ °C./sec. | TS kg/mm² | YS/TS | El % | Remarks |
| Steels | C | Si | Mn | °C. | °C. | | | | | | | | |
| K* | 0.12 | 1.41 | 1.59 | 890 | 600 | 800° C. 1 min. | 7 | 500 | 10 | 92.8 | 0.41 | 17.6 | |

Remarks:
*represents 0.8 mm thick cold rolled steel sheets (D, E, F, K); others are 2 mm thick hot rolled steel sheets (G, H, I, J)
◎represents the continuous annealing and cooling patterns according to the present invention; others are conventional simple cooling.

What is claimed is:

1. In a process for producing a dual-phase structure steel sheet comprising hot rolling a steel containing 0.03 to 0.12% C, not more than 0.8% Si, and 0.8 to 1.7% Mn with the balance being iron and unavoidable impurities, and continuously annealing the hot rolled steel sheet in a range from 730° to 900° C., improvements comprising cooling the continuously annealed steel sheet under the following conditions:

(1) 1° C./second $\leqq R_1 \leqq$ 30° C./second
wherein $R_1$ represents an average cooling rate from the continuous annealing temperature down to an intermediate temperature T°C. in the cooling process (2) 4° C./second $\leqq R_2 \leqq$ 100° C./second
wherein $R_2$ represents an average cooling rate from T°C. to a temperature not higher than 200° C.

(3) $R_1 < R_2$
and (4) 420° C. $\leqq T \leqq$ 700° C.
to obtain high strength, low yield ratio of not over 0.6 and high ductility dual-phase structure steel sheet having a structure composed mainly of a ferrite phase and a rapidly cooled transformation phase and having excellent formability with a tensile strength of 40 kg/mm² or higher.

2. Improvements according to claim 1, in which the secondary cooling rate $R_2$ represents an average cooling rate from T°C. down to a temperature not higher than 350° C.

3. Improvements according to claim 1, which further comprises coiling the hot rolled steel sheet and slowly cooling the coiled steel sheet.

4. Improvements according to claim 3, in which the coiling is done at a temperature ranging from 670° to 780° C.

5. Improvements according to claim 1, in which the hot rolling is finished at a temperature ranging from 720° to 820° C.

6. Improvements according to any one of claims 1 to 5 in which the cooling after the annealing is done while the steel sheet is passed through a molten metal bath maintained at the intermediate temperature T bordering the primary cooling and the secondary cooling and surface coating the steel sheet with said metal.

7. Improvements according to any one of claims 1 to 5, in which the cooling after the continuous annealing is done while the steel sheet is passed through a molten metal bath for surface coating and further comprises cold rolling prior to the continuous annealing.

8. Improvements according to claim 1 in which $R_1$ is in the range of 1° C./second $\leqq R_1 \leqq$ 25° C./second, $R_2$ is in the range of 4° C./second $\leqq R_2 \leqq$ 90° C./second and T is in the range of 440° C. $\leqq T \leqq$ 680° C.

* * * * *